United States Patent [19]

Curtin

[11] 4,288,015

[45] Sep. 8, 1981

[54] CONTACTLESS WEB TURNING GUIDE

[75] Inventor: Larry E. Curtin, Rockford, Ill.

[73] Assignee: W. R. Grace & Co., New York, N.Y.

[21] Appl. No.: 120,707

[22] Filed: Feb. 11, 1980

[51] Int. Cl.[3] ..... B65H 23/24; B65H 23/32; B65H 17/32

[52] U.S. Cl. ..... 226/97; 226/197

[58] Field of Search ..... 226/97, 7, 197; 134/156; 242/76; 302/29, 31

[56] References Cited

U.S. PATENT DOCUMENTS

| | | | |
|---|---|---|---|
| 2,753,181 | 7/1956 | Amander | 226/97 |
| 3,385,490 | 5/1968 | Malmgren et al. | 226/97 |
| 3,971,496 | 7/1976 | Karsh | 226/97 |
| 4,131,320 | 12/1978 | Volat et al. | 226/97 |
| 4,182,472 | 1/1980 | Peekna | 226/97 |
| 4,197,972 | 4/1980 | Daana | 226/97 |

*Primary Examiner*—Billy S. Taylor

*Attorney, Agent, or Firm*—James E. Nilles

[57] ABSTRACT

A contactless web turning guide comprises a guide member that extends across the web and curves arcuately along a direction in which the web moves. The web floats in proximity to the convex surface of the guide member on a film of air confined by means of elongated air nozzles around its periphery. A pair of elongated edge-jet outlets extends along each edge of the web, parallel to the web edges, from one to the other of said nozzles. One edge-jet outlet of each pair is spaced a small distance outwardly from its adjacent web edge, the other a small distance inwardly from that edge, and the two edge-jet outlets of each pair discharge air along said surface in the direction across the width of the web towards the other pair of edge-jet outlets. Such edge-jet outlets conserve energy required for pressure air generation while affording more stable web travel.

3 Claims, 6 Drawing Figures

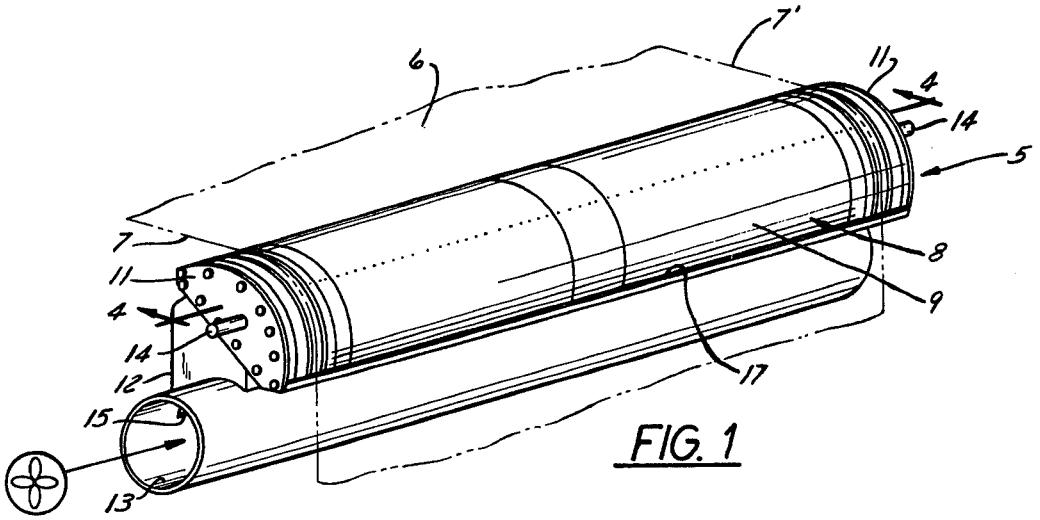
FIG. 1
FIG. 2
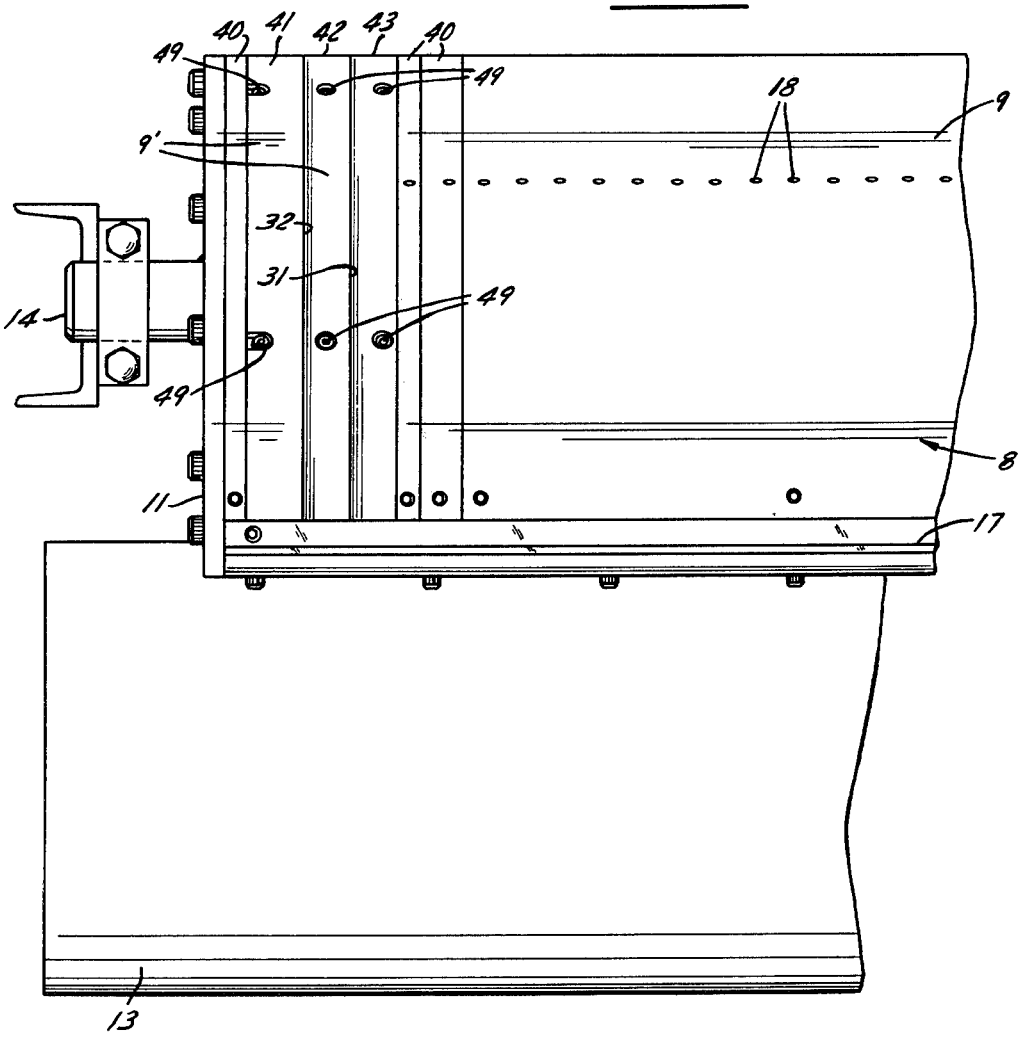

CONTACTLESS WEB TURNING GUIDE

FIELD OF THE INVENTION

This invention relates to contactless web turning guides whereby a web of paper or the like that extends along a defined path and runs lengthwise in that path in contactlessly supported and guided through an arcuate turn in a portion of its path; and the invention is more particularly concerned with improvements in such web turning guides to achieve a substantial reduction in the amount of pressure air needed for maintaining contactless floating of the web and to better confine the web against flapping, crinkling and edgewise displacement as it moves through the zone of the turning guide.

BACKGROUND OF THE INVENTION

Contactless web turning guides are employed for the guidance of webs of paper and similar materials, to effect a change in the direction of the web without permitting the web to make contact with a solid surface. In general, such a turning guide has an arcuate guide surface which is convexly curved along the direction of movement of the web and which the web follows to undergo change of direction. Pressure air outlets at various locations in or adjacent to the guide surface maintain pressure air between that surface and the web, so that the web floats on a film of air that keeps it spaced from the guide surface even as it closely follows the guide surface curvature.

One form of contactless web turning guide is disclosed in the allowed copending application of Robert A. Daane, Ser. No. 937,468, filed Aug. 28, 1978 (now U.S. Pat. No. 4,197,972 issued Apr. 15, 1980) which has a common assignee herewith. In the guide there disclosed, the web was floated on pressure air issuing from air nozzles under the web that extended across substantially the full width of the web and were spaced from one another around the curved guide surface. In addition, a stream of air was directed towards each edge of the web from an elongated edge-jet air outlet that was spaced a little distance outwardly from each edge of the web and extended parallel to the web edge. The air stream blown from each of these edge-jet outlets retarded the outflow of pressure air from under the web and also acted on the web to confine it against edgewise side drift.

Although this prior arrangement was by no means unsuccessful or unsatisfactory, the present invention has resulted from efforts to achieve substantial improvements in it, particularly with respect to reducing the energy that it consumes for supplying pressure air and increasing the stability of the moving web in the portion of its path that is defined by the turning guide.

In initial efforts to achieve these objectives, the elongated edge-jet outlets that were located in outwardly spaced relation to the web were replaced by similar outlets located just under the web, near its side edges, each discharging air in a laterally inward direction relative to the web. Such air outlets were found not to provide sufficient support under the marginal portion of the web, with the result that there was folding down and dragging of the web edge.

The present invention involves the surprising discovery that two properly arranged elongated edge-jet air outlets at each side of the web, instead of the single such outlet heretofore used, will materially reduce pressure air requirements instead of having the expectable result of increasing the requirements for pressure air, and, moreover, will bring about greatly improved web stability and web tracking.

Thus the general object of the present invention is to provide an improved web turning guide for contactlessly supporting and guiding a web around an arcuate turn in a portion of a defined path along which the web extends and runs, and particularly to provide an improved arrangement of air jet outlets for such a web turning guide whereby substantially less energy is needed for operation of the web turning guide and whereby better tracking and guidance and more stable running of the web is obtained.

It is also an object of this invention to provide a contactless web turning guide that is readily adaptable for cooperation with a web of any of several different widths and which requires a relatively small quantity of pressure air at a relatively low pressure for maintaining a flotation film between the web guide surfaces and a web but nevertheless affords excellent tracking and very stable running of the web, with very uniform pressure air support of the web all across its width and around the curve defined by the turning guide.

SUMMARY OF THE INVENTION

The contactless web turning guide of this invention affords contactless support to a web that has a given width and runs lengthwise along a defined path to guide the web around an arcuate turn in a portion of that path. Said web turning guide has a surface which is convexly curved in the direction that the web runs and has nozzle outlets which are elongated transversely to that direction, are spaced from one another in said direction, and are arranged to maintain a film of web supporting pressure air between said surface and a web. There is an area of said surface which is normally overlain by a web and which extends from one to the other of said nozzle outlets and has parallel boundaries that extend in said direction and are spaced apart by a distance equal to the given width of the web.

The contactless web turning guide of this invention is characterized by: two pairs of elongated edge-jet outlets, one pair for each of said boundaries, the two edge-jet outlets of each pair being spaced small distances to opposite sides of the boundary for the pair and each extending parallel to that boundary substantially from one to the other of the nozzle outlets, each of said edge-jet outlets being arranged to issue pressure air along said surface in the direction towards the edge-jet outlets of the other pair.

BRIEF DESCRIPTION OF THE DRAWINGS

In the accompanying drawings, which illustrate what are now regarded as preferred embodiments of the invention:

FIG. 1 is a perspective view of a web turning guide embodying the principles of this invention;

FIG. 2 is a fragmentary view in front elevation of an end portion of the turning guide, on a larger scale;

DETAILED DESCRIPTION OF PREFERRED EMBODIMENTS OF THE INVENTION

Figure 3:
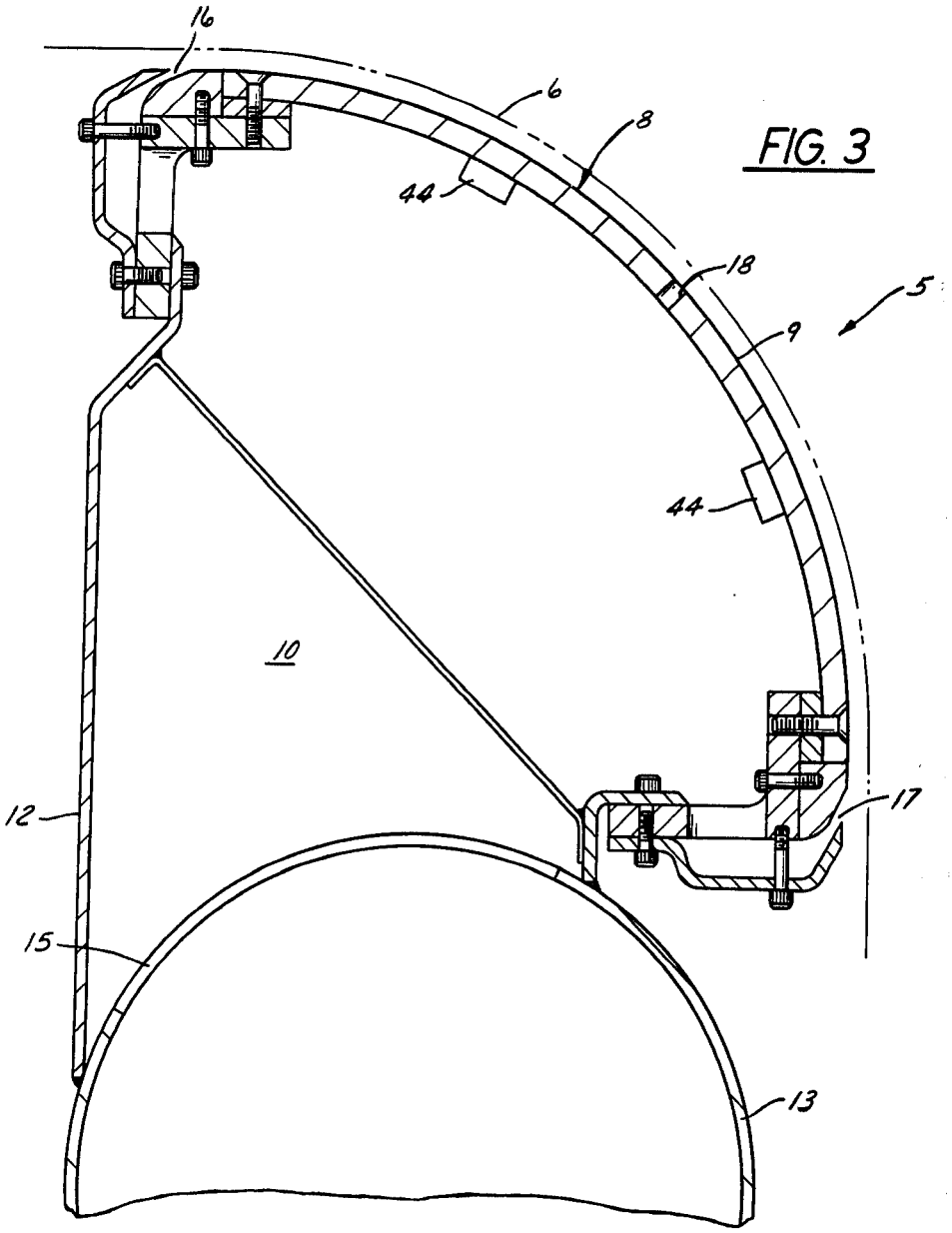
FIG. 3 is a sectional view of the turning guide, on a still larger scale, taken parallel to the direction in which the web runs.

Referring now to the accompanying drawings, the numeral 5 designates generally a web turning guide embodying the principles of this invention, whereby a lengthwise running web 6 of paper or the like is guided through an arcuate turn in a portion of a path along which the web extends. The web 6 has straight and parallel side edges 7, so that it has a given constant width all along its length, and it moves in a direction parallel to said edges 7.

The web turning guide 5 comprises a guide member 8, which can be in the nature of a metal sheet or plate. The guide member 8 is arcuately curved in the direction that the web 6 runs, and transversely to that direction it extends sidewardly beyond the edges 7 of the web. The convex surface 9 of the guide member 8 is of course the one that affords guidance to the web 6, and the web floats at a small distance (1/16 to ⅛ inch) from that surface.

The guide member 8 comprises one wall of a plenum chamber 10, which it defines in cooperation with side plates 11, a rear wall 12 and a pressure air duct 13. Shaft means 14, projecting outwardly from the side plates 11, substantially on the axis of curvature of the guide surface 9, provide for mounting the web turning guide 5 on a machine frame.

The duct 13 by which pressure air is delivered to the plenum chamber 10 extends along the bottom of the plenum chamber and has outlets 15 in its top, at intervals along its length, that open into the plenum chamber.

The film of pressure air upon which the web 6 is floatingly supported as it passes in guided relation to the surface 9 is confined by the air nozzles around its periphery. Nozzles 16, 17, 31 open from the plenum chamber 10 through the guide member 8. Air issuing from these nozzles is deflected outward by the pressure under the web and forms, in effect, a curtain which traps a film of pressure air under the web. The airstream 36 that issues from each of the outer edge-jet nozzles 32, and which is directed towards the adjacent web edge 7, tends to reduce the outward flow of pressure air from the inner edge-jets 31, and provides support for the web in the region between the web edge 7 and the inner edge-jet 31. It is deflected radially outwardly, away from the curved surface 9, by the pressure air flowing out from under the edge of the web.

The pressure air outlet nozzles 18, which are located between the nozzles 16 and 17, can comprise a series of holes that open from the plenum 10 through the guide member 8, aligned in a row that extends lengthwise parallel to the elongated nozzles 16 and 17. The provision of the outlet nozzles 18, intermediate the nozzles 16 and 17, causes the web 6 to have more stable movement around the web turning guide 5, with no tendency to slap or flutter. If the holes that comprise the outlet nozzles 18 are all of uniform size, they can all normally be spaced apart by uniform distances. However, for certain types of webs it may be desirable to slightly reduce the spacings between holes at the ends of the row, for an increase in pressure under the marginal portions of the web.

At this point it will be apparent that there is a certain area of the guide surface 9 that the web 6 normally overlies, and when the web is tracking properly, its edge 7 coincide with imaginary boundaries 7' of that area, which boundaries are thus parallel to one another and extend around the curve of the surface 9 in the direction of travel of the web 6.

According to the present invention, there are two pairs of elongated edge-jet pressure air outlets 31, 32 in the guide member 8, each pair being adjacent to an edge 7 of the web, and hence adjacent to one of the boundaries 7' just mentioned. All of these edge-jet outlets 31, 32 open from the plenum chamber 10 through the guide member 8, and each is long enough to extend around the curve of the guide surface 9, parallel to the above-mentioned boundaries 7', substantially from one to the other of the air outlet nozzles 16 and 17. Thus, near each edge of the web there is an inner edge-jet outlet 31 which lies within the area normally overlain by the web and an outer edge-jet outlet 32 which lies just outside that area. It will be apparent that the distance between the two inner edge-jet outlets 31 is less than the width of the web 6 by a small amount, while the distance between the two outer edge-jet outlets 32 is greater than the width of the web by about an equal amount. Typically, with a web in the 36-inch to 40-inch width range, the distance between each inner edge-jet outlet 31 and its adjacent outer edge-jet outlet 32 is 1 inch.

Figure 4:
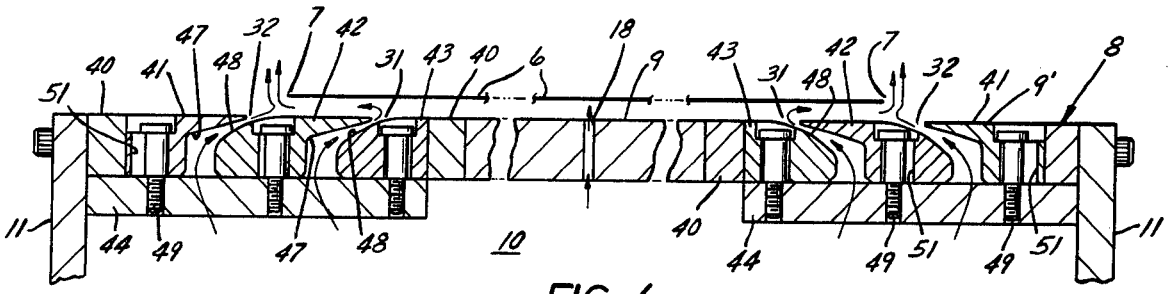
FIG. 4 is a sectional view taken on the plane of the line 4—4 in FIG. 1.
Figure 5:
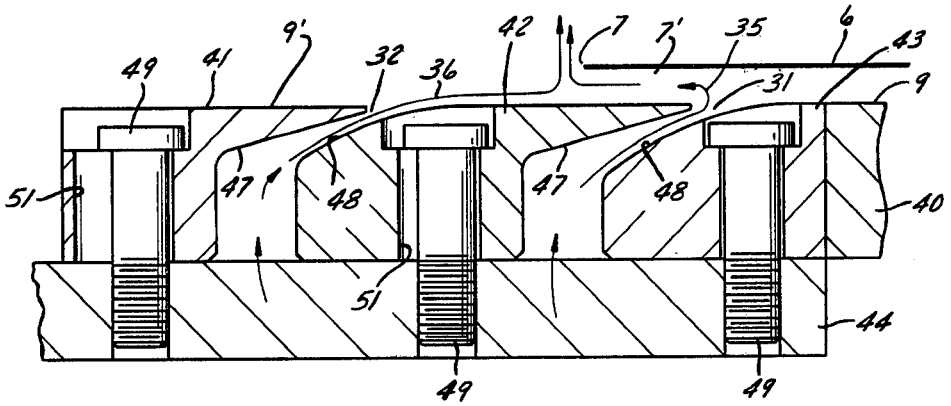
FIG. 5 is a fragmentary sectional view generally on the same plane as FIG. 4 but on a larger scale.

As shown in FIGS. 4 and 5, pressure air that issues from the edge-jet outlets 31 and 32 that are adjacent to a boundary 7' is directed across the guide surface 9 in the direction towards the other pair of edge-jet outlets 31, 32 and thus laterally inwardly relative to the web 6.

It will be evident that the combined effect of the air streams 35, 36 issuing from the respective edge-jet outlets 31 and 32 is to trap a film of pressure air underneath the web nearly as efficiently as the nozzles 16, 17 and yet offer adequate support for the marginal web regions between the web edge 7 and the inner edge jet 31. This brings about a substantial reduction in the amount (cubic feet per minute) of pressure air that has to be pumped through the plenum chamber 10 in order to maintain adequate flotation of the web. In tests with a 38-inch wide web, it was found that with a single edge-jet air outlet at each side of the web, spaced just outwardly of each web edge 7 in correspondence with the outer edge-jets 32, generation of sufficient pressure air for web flotation needed 6 horsepower; whereas with the two edge-jet outlets 31 and 32 along each web edge, as just described, only 4.7 horsepower was needed. The lower horsepower was accounted for by the fact that both a lower air flow rate and a lower air pressure could be used with the arrangement of this invention. Notwithstanding such lower energy consumption, the web showed no tendency to slap or flutter as it moved around the web turning guide, and it was not much affected by changes in its tension and variations in the pressure of air under it, maintaining a smooth curve with no tendency to crinkle.

With the contactless web turning guide disclosed in the aforesaid Daane application, it sometimes happened that marginal portions of the web were poorly supported in the vicinity of the nozzle outlets 16 and 17 that extended across the web, notwithstanding provision of edge-jets corresponding to the outer edge-jet 32 of the present invention. With the two edge-jets 31, 32 of this invention, the web tends to be uniformly supported for flotation on pressure air all across its width and along the curve of the arcuate guiding surface 9.

The arrangement of this invention also affords improved web tracking, stabilizing the web against excessive edgewise drift from side to side. At the side towards which the web drifts, the web extends farther across the inner edge-jet outlet 31 and runs closer to the outer edge-jet outlet 32, with the result that air pressure increases under the marginal portion of the web at that side. Meanwhile, there is a decrease in air pressure under the opposite marginal portion of the web. As a web edge gets very close to the outer jet, there is a significant increase in support under that edge, and this tilts the web at an inclination to the guide surface 9 and causes it to slide edgewise back toward its assigned path.

The edge-jet outlets 31 and 32 are defined by elongated strip-like members 40, 41, 42, 43, each curved along its length to have an outer surface 9' which comprises a part of the guide surface 9. Each of the several strip-like members 40, 41, 42, 43 is supported at each of its ends by a bar 44 that extends transversely to it and has screw holes at intervals along its length.

The strip-like members 40 are of rectangular cross-section and serve as spacers that can be positioned as necessary to establish the locations of the edge-jet outlets 31, 32 in relation to the edges 7 of the web being run.

The strip-like members 41, 42, 43 define the outlets 31, 32 proper. Each of the strip-like members 41 has one flat side, to abut a spacer strip 40, and has an opposite side which is concavely curved in cross-section profile, as at 47, to provide an outer slot surface which deflects air edgewise inwardly relative to the web. Each of the strip-like members 43 is likewise formed with one flat side for abutment against a spacer strip 40 and with an opposite side that has a convexly curved cross-section profile 48 that is complementary to a concavely curved surface 47. Each strip-like member 42 has one concavely curved surface 47 and one convexly curved surface 48. The several members 41, 42, 43 are so arranged that each concavely curved surface 47 cooperates with an adjacent convexly curved surface 48 to define a properly oriented jet outlet.

Screws 49 that secure the outlet-forming members 41, 42, 43 to transverse supporting bars 44 extend through slots 51 in the respective members 41, 42, 43, each such slot being elongated transversely to the length of the member in which it is formed so that the lateral positions of said members 41, 42, 43 can be adjustably varied to some extent for adjustment of the relative widths of the edge-jet outlets 31, 32.

Figure 6:
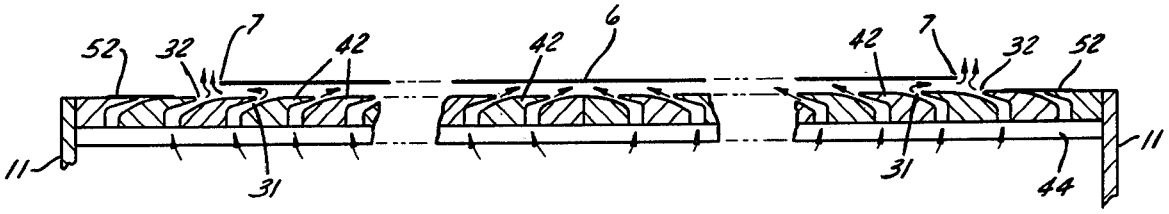
FIG. 6 is a view generally similar to FIG. 4 but illustrating a modified embodiment of the invention.

In the embodiment of the invention illustrated in FIG. 6, the guide member 8 comprises numerous members 42 in side-by-side relation across the width of the guide, defining numerous parallel slot-like outlets, any of which can be selected to serve as the respective inner and outer edge-jet outlets 31 and 32, depending upon the width of the web to be run. The two slots that are inwardly adjacent to the respective edges 7 of the web will thus constitute the inner edge-jet outlets 31. In some cases, the remaining slots that are under the web may be left open, or they may be shut off by an internal valving or blocking arrangement. However, if a particular web is narrower than the widest web for which the turning guide 5 is adapted, there may be two or more slots outwardly of each edge 7 of the web, and all but one of these should be blocked. This is easily done by taping shut the unneeded slots, as designated by 52. Of course the one slot that is outwardly adjacent to each edge 7 of the web will be left open to serve as an outer edge-jet outlet 32.

From the foregoing description taken with the accompanying drawings it will be apparent that this invention provides a contactless web turning guide which conserves energy by requiring less pressure air, at lower pressure, than equivalent prior devices and which nevertheless ensures stable running of the web with good edgewise tracking and no tendency towards crinkling or flapping.

I claim:

1. A web turning guide whereby a web that runs lengthwise along a defined path is contactlessly supported and guided through an arcuate turn in a portion of said path, said guide having a surface which is convexly curved in the direction that the web runs, and having means for maintaining a film of pressure air between said surface and a web, there being an area of said surface which is normally overlain by a web and which has parallel boundaries that extend in said direction and are spaced apart by a distance equal to the width of the web, said web turning guide being characterized by:

a pair of elongated pressure air edge-jet outlets adjacent to each of said boundaries, each of said edge-jet outlets extending substantially parallel to said boundaries and substantially entirely along said area in the direction that the web runs, each pair of edge-jet outlets comprising (1) an outer edge-jet outlet spaced a small distance outwardly of its adjacent one of said boundaries, to be outside said area, and (2) an inner edge-jet outlet within said area and spaced a small distance from its adjacent one of said boundaries to be overlain by a marginal portion of a web, means positioning both edge-jet outlets of each pair to direct pressure air along said surface in the direction towards the other pair of edge-jet outlets; and means for directing pressurized air to each of said edge just outlets.

2. The web turning guide of claim 1, further characterized by:

further elongated pressure air outlets within said area, each extending parallel to said boundaries, all of said further pressure air outlets being located between said inner edge-jets and spaced from the same and from one another.

3. A web turning guide whereby a web that has a given width and runs lengthwise along a defined path is contactlessly supported and guided through an arcuate turn in a portion of said path, said guide having a surface which is convexly curved in the direction that the web runs and having nozzle outlets which are elongated in said direction and are spaced from one another transversely to said direction, whereby a film of web supporting pressure air is maintained between said surface and a web, there being an area of said surface which is normally overlain by a web and which extends from one to the other of said nozzle outlets and has parallel boundaries that extend in said direction and are spaced apart by a distance equal to said width, said web turning guide being characterized by:

two pairs of elongated edge-jet outlets, one pair for each of said boundaries, the two edge-jet outlets of each pair being spaced small distances to opposite sides of the boundary for the pair and each extending parallel to that boundary substantially from one to the other of said nozzle outlets, means positioning said edge-jet outlets of each pair to issue pressure air along said surface in the direction towards the edge-jet outlets of the other pair; and means for supplying pressurized air to each of said edge jet outlets.

* * * * *